US005429359A

United States Patent [19]

Timperman et al.

[11] Patent Number: 5,429,359

[45] Date of Patent: Jul. 4, 1995

[54] HOVERING CRAFT AND GAME

[76] Inventors: Eugene L. Timperman, 10639 Silverbrook Dr., Cincinnati, Ohio 45240; Le T. Phan, 3235 Ferncroft, Cincinnati, Ohio 45211

[21] Appl. No.: 243,553

[22] Filed: May 16, 1994

Related U.S. Application Data

[63] Continuation of Ser. No. 248, Jan. 4, 1993, abandoned.

[51] Int. Cl.[6] ..... A63B 67/14; A63F 7/07

[52] U.S. Cl. ..... 273/126 A; 273/128 R

[58] Field of Search ..... 273/126 R, 126 A, 128 R, 273/128 A, 128 CS; 446/178, 179

[56] References Cited

U.S. PATENT DOCUMENTS

| | | | |
|---|---|---|---|
| D. 287,234 | 12/1986 | Chia . | |
| 2,159,966 | 5/1939 | Dunham | 273/126 R |
| 3,078,938 | 2/1963 | Bollum, Sr. . | |
| 3,078,939 | 2/1963 | Bollum, Sr. . | |
| 3,090,327 | 5/1963 | Crowley . | |
| 3,090,455 | 5/1963 | Crowley . | |
| 3,153,461 | 10/1964 | Bollum, Sr. . | |
| 3,177,959 | 4/1965 | Gaska . | |
| 3,195,665 | 7/1965 | Beardsley . | |
| 3,229,410 | 1/1966 | Bross | 446/179 |
| 3,263,764 | 8/1966 | Bertin . | |
| 3,331,462 | 7/1967 | Wernicke . | |
| 3,365,017 | 1/1968 | Hardy et al. . | |
| 3,488,882 | 1/1970 | Scott | 446/179 |
| 3,536,155 | 10/1970 | Bertin . | |
| 3,548,969 | 12/1970 | Weston . | |
| 3,656,575 | 4/1972 | Vryland . | |
| 3,687,217 | 8/1972 | Mueller . | |
| 3,691,670 | 9/1972 | Lemelson | 446/179 |
| 3,747,726 | 7/1973 | Walter . | |
| 3,870,309 | 3/1975 | Tessier | 273/128 CS |
| 3,954,267 | 5/1976 | Freeman et al. | 273/126 A |
| 4,068,735 | 1/1978 | Grihangne . | |
| 4,076,242 | 2/1978 | Joseph | 273/126 R X |
| 4,175,637 | 11/1979 | Bertelsen . | |
| 4,249,334 | 2/1981 | Goldfarb et al. | 446/179 |
| 4,416,346 | 11/1983 | Logan . | |
| 4,427,086 | 1/1984 | de Coiselet . | |
| 4,507,096 | 3/1985 | Greenfield, Jr. . | |
| 4,516,651 | 5/1985 | Duchateau . | |
| 4,666,012 | 5/1987 | Howell et al. . | |
| 4,964,835 | 10/1990 | Suto | 446/179 |
| 5,014,990 | 5/1991 | Kaser et al. | 273/128 R |
| 5,045,013 | 9/1991 | Fujitani | 446/179 |

FOREIGN PATENT DOCUMENTS

| | | |
|---|---|---|
| 2070003 | 6/1992 | Canada . |

*Primary Examiner*—Raleigh W. Chiu
*Attorney, Agent, or Firm*—Frost & Jacobs

[57] ABSTRACT

An axial or centrifugal fan is motor mounted and the motor in turn is mounted within the central portion of a preferably low density or light weight annular or orientation free structure. Fan driven air is delivered downwardly through the central portion of the structure and is efficiently diffused underneath thereof. The air exits to atmosphere through an air bearing or a peripheral nozzle, both of which provide a strong stabilizing moment to the craft. The annular structure simulates a hockey puck to be used in a game similar to ice or field hockey. The Puck can be motivated from player to player and subsequently toward a goal by the players feet or by other desirable instruments. The preferred goal is comprised of a horizontal bar to encourage players to keep the toy on the playing surface. The puck is provided with a resilient outer periphery to prevent damage to itself and the playing environment. If a non-rotating puck or toy is contemplated, a dynamic anti-torque model incorporates two counter-rotating motors and fans in a statorless arrangement.

9 Claims, 8 Drawing Sheets

HOVERING CRAFT AND GAME

This is a continuation of U.S. application Ser. No. 08/000,248, filed Jan. 4, 1993, now abandoned.

BACKGROUND

Hockey is a well known game played on ice with a hard rubber puck. Some of the attractive features that contribute to its popularity are its speed, skill and roughness. It should be noted that, for most of the time the puck stays on the playing surface. For most people it is a spectator sport. Other approaches have been used to broaden participation, at least in concept. Field hockey requires organized teams and a rather large flat playing field. Use of a ball in place of a puck suffices in this situation since there is time and space for the ball puck to come back down to the playing surface. For most of the time play is conducted in a two dimensional environment.

Attempts to play a hockey style game with a ball and roller skates have not been too popular since the ball bounces and is too free. A three dimensional hockey game can be very difficult. An appropriate site in most cases is not readily available. Also roller skates do not provide the maneuverability of ice skates. Some improvement has been made with the advent of in-line roller skates, but an acceptable site and expense are still major limitations.

A dry land hockey type game that would make use of readily accessible flat surfaces or areas could be attractive if the expense is limited. Small flat areas around homes and schools are available if the game can be configured properly. Some typical areas would be basement floors, hallways, driveways, parking lots and gym floors for example.

The use of hard pucks designed for high speeds is unacceptable since damage to the interior of a home or recreational building or injury to the casual players could result. A levitating or floating puck may provide a suitable solution for the dry land hockey approach. A table top game, known as "air hockey" has become fairly popular. The "puck" is a disc of material supported above a surface on a film of air. The air is supplied through holes in the supporting surface of a table. Consequently the game requires a specially constructed double shell table with goal ports at each end, and a motor and blower. It is a fairly expensive device. Again the attractive feature to this approach is speed. The model puck has to be very durable.

Air cushion technology is well known at this time, but its application to toys has been very limited. The full scale Bell and British hovercraft utilizes a plenum chamber air cushion concept stabilized by a flexible air bearing peripheral bag. A radio controlled toy of this machine has been marketed in recent years. Its performance is found to be lacking due to excessive weight.

U.S. Pat. No. 3,687,217 to Mueller discloses a gasoline powered model hovercraft vehicle that is an inverted shell type structure. Anti-rotation vanes are integral with the formed shell as well as a peripheral flange for added stability. The anti-rotation means will reduce torque rotation but will not eliminate it unless the anti-torque means is dynamic and capable of sensing unbalanced torque. As a toy the model is delicately constructed, has an unpredictable directional character, and is vehicular in shape and appearance. The use of a model aircraft engine presents further problems. If used roughly it could present a fire hazard. Also the propeller or fan is unprotected and would be unsafe for children.

The question is how does one produce a puck that slides freely on the above mentioned surfaces and is sufficiently durable to tolerate a modified hockey style environment and cause no damage to its environment. Air cushion technology could provide an answer but hovering performance, efficiency and structural durability are technical difficulties. Hovering performance has to do with power. Such a device would have to be electric powered, preferably by battery and is therefore a challenge in efficiency.

There are many forms of air cushion vehicles. Of interest here are the plenum chamber and the peripheral jet configurations. With respect to a self powered puck the plenum chamber configuration offers simplicity of structure and durability while it lacks in hovering performance and height. It would operate properly over only the smoothest of surfaces such as hardwood and plastic floors or troweled concrete. On the other hand the peripheral jet configuration enhances hovering performance and stability at the sacrifice of structural simplicity and possibly durability, but might afford the opportunity to traverse moderate piled rugs and rough concrete. Either approach requires a proper selection of material or some peripheral cushioning to render the toy non-damaging to a household environment and the players. Development of an appropriate configuration is therefore not simplistic and depends upon the particular support surface. Such a hovering puck could also function as a stand alone toy which would include configurations other than circular. As a stand alone toy, anti-rotation may be preferable.

SUMMARY OF THE INVENTION

This invention relates to a game which utilizes a self-levitating or floating toy in which the players attempt to move the toy across a goal line between two goals. In the furtherance of the practice of the game, this invention also relates to a battery powered air cushion toy for almost frictionless movement over relatively smooth and flat surfaces. The toy is intended to be used in a game played according to the general concept of ice hockey. It may be configured in a puck like shape that is round or orientation free with a proportionate thickness. It may be motivated by foot as well as by hockey type sticks, brooms or other similar instruments. The general concept is for at least two players to compete in attempting to motivate the self levitating toy between a pair of goal posts. The goal may also include a horizontal goal bar suspended above the floor a sufficient height to permit the toy to pass under it with ample clearance. This approach would encourage the players to keep the toy on the supporting surface since the device is not intended to go airborne.

The self levitating or floating toy may also be used independent of the game as an individual toy.

The floating toy may be constructed of expanded plastic and include a toroidal and possibly decorative plastic covering to aid in its durability. Its core structure may be injected molded for rigidity and durability while it is rendered non-damaging by a toroidal foam plastic or rubber cushion.

Anti-rotation is not considered a necessity in a self levitating toy since the body rotation adds another degree of uncertainty to the game. The self levitating toy is also used as a toy independent of the game to be enjoyed by even small children. In this configuration anti-rotation may be desirable. According to one embodiment of the toy, anti-rotation can be accomplished without outlet stator vanes. One embodiment of the floating toy includes a non-rotating platform achieved by employing a twin motor design, one motor rotating in opposition to the other. Counter rotating flows within the craft must be made to exit the periphery of the toy uniformly, that is, approximately the same flow velocity and exit angle should exit the periphery of the toy at all radial locations thereabouts. Therefore a central flow barrier was employed to separate and direct the flow in a sufficiently uniform manner toward the periphery of the craft. The statorless design also proved to be more efficient. Therefore in a battery powered twin motor toy good performance has been achieved in a statorless design with perfect anti-rotation.

One object of the present invention is to provide a game which utilizes a self-levitating or floating toy in which the players attempt to motivate the toy across a goal line.

Another object of this invention is to provide a self-levitating or floating toy which can be used in playing the game of this invention.

Another object of this invention is to successfully model air cushion technology in toy size and form.

Another object of this invention is to provide a battery powered air cushion toy.

Another object of this invention is to provide an air cushion toy in the general shape of a hockey puck capable of hovering over a flat surface for an acceptable length of time.

Another object of this invention is to provide a hovercraft toy in the shape of a hockey puck to be sufficiently sturdy to be motivated by one's foot, broom, hockey stick or the like.

Another object of this invention is to provide a plenum chamber type of air cushion toy with sufficient air bearing surface to produce acceptable stability at minimum power consumption.

A further object of this invention is to provide a toy hovercraft with anti-torque capability in a statorless design.

Additional objects, advantages and other novel features of the invention will be set forth in the description that follows and in part will become apparent to those skilled in the art upon examination of the following or may be learned with the practice of the invention. The objects and advantages of the invention may be realized and obtained by means of the instrumentality's and combinations particularly pointed out in the appended claims.

To achieve the foregoing and other objects, and in accordance with the purposes of the present invention as described herein, a method of playing a game is disclosed which includes providing a playing surface, providing a floating craft, providing at least one goal, and providing at least one team with at least one player, the team having an object of moving the craft across its respective goal.

In accordance with another aspect of this invention, the game includes first and second teams, with each team having an object to move the craft across its respective goal.

In accordance with yet another object of the present invention, each team has an object of preventing the movement of the craft across the other team's respective goal.

In accordance with another object of the present invention, there are provided various designs for floating crafts which are capable of being used individually or in the game.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

Reference will now be made in detail to the present preferred embodiment of the invention, an example of which is illustrated in the accompanying drawings.

DETAILED DESCRIPTION

The game according to my invention will be described below, following the detailed description of various embodiments of a self-levitating or floating toy which I have invented which are particularly well suited for use in my game. Of course, it should be realized that other embodiments of floating toys may be used without departing from the spirit of my game.

Mechanical

Figure 1:
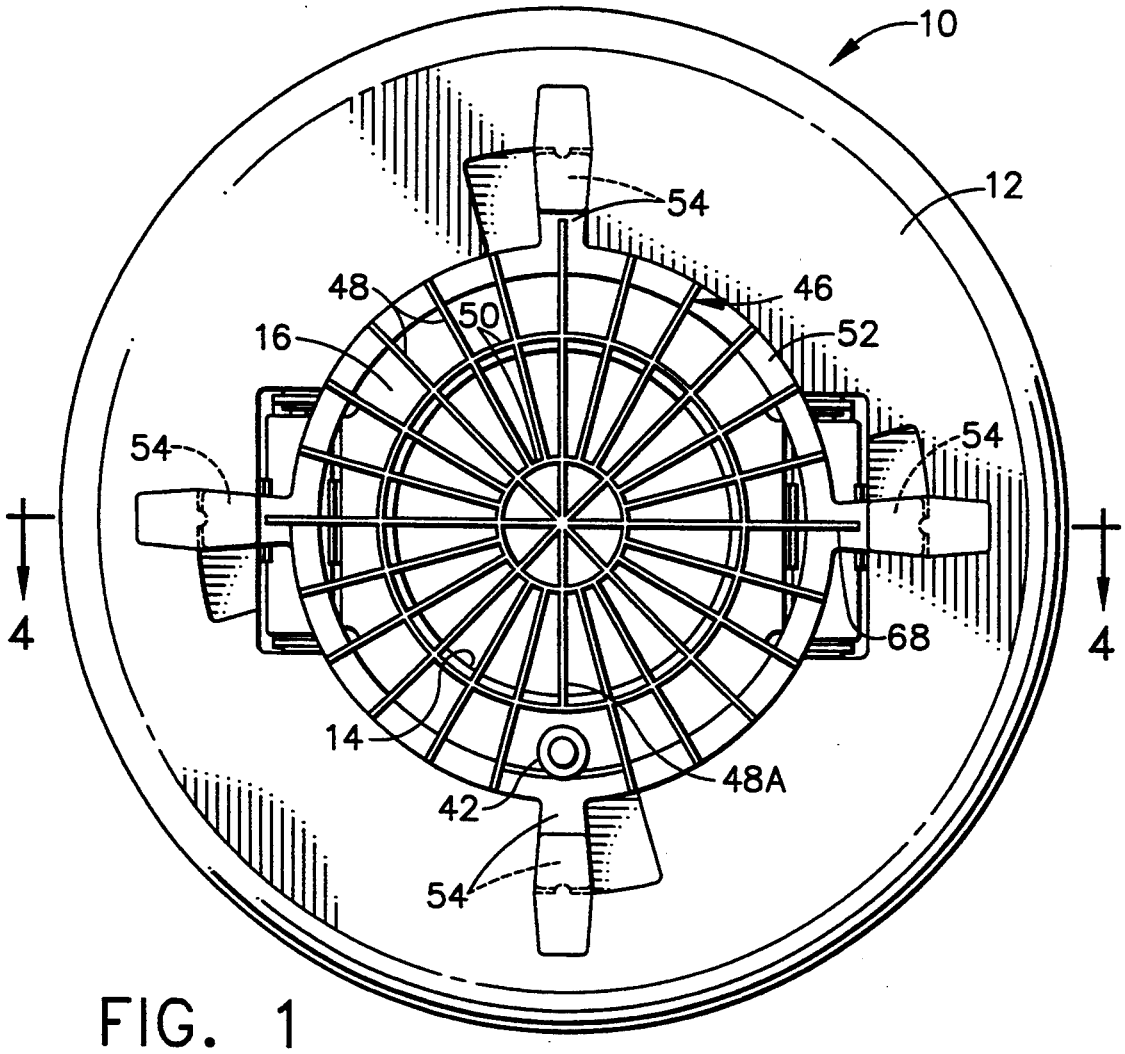
FIG. 1 is a plan view of the hovercraft toy constructed in accordance with a preferred embodiment of this invention.
Figure 3:
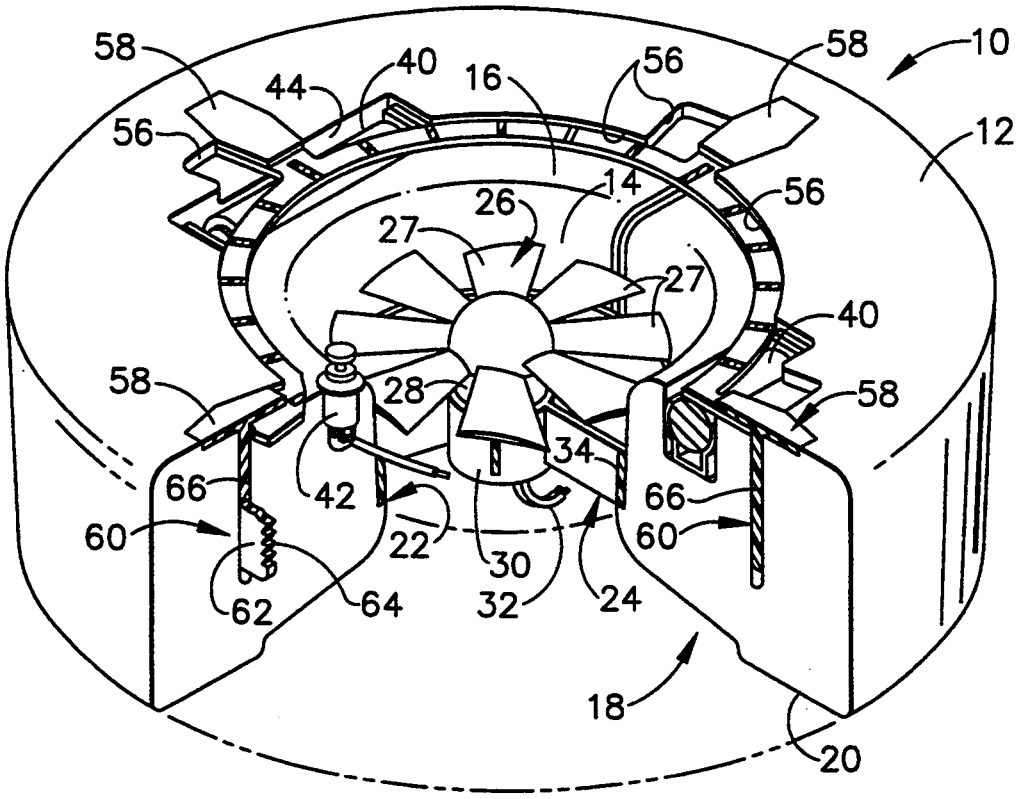
FIG. 3 is a perspective view of the hovercraft toy with a section broken away for exposition of its internal parts.
Figure 4:
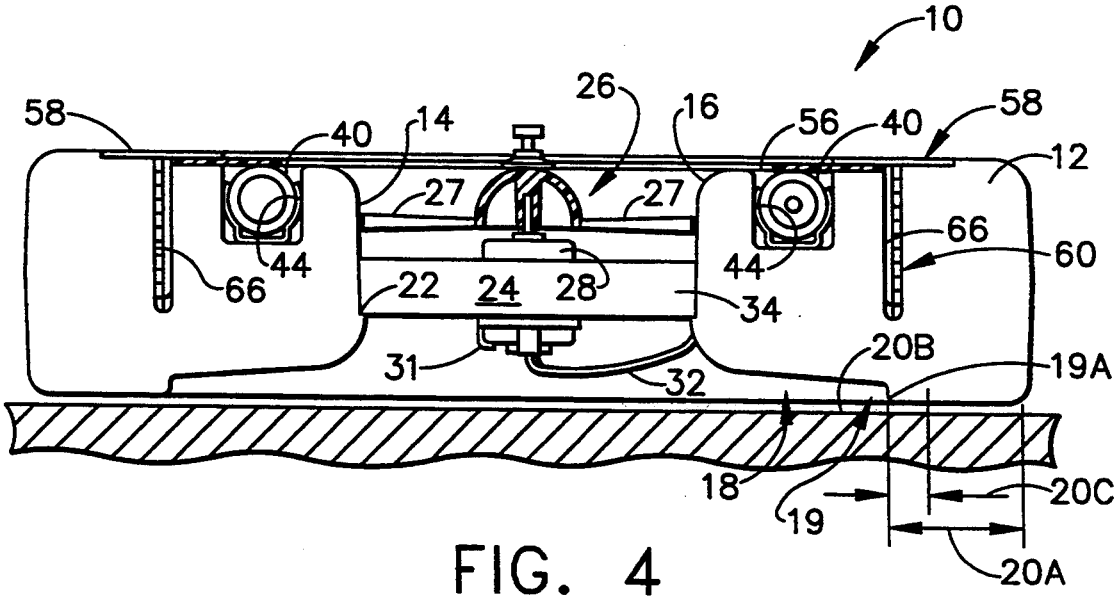
FIG. 4 is an upright sectional view taken generally along line 4—4 of FIG. 1.
Figure 5:
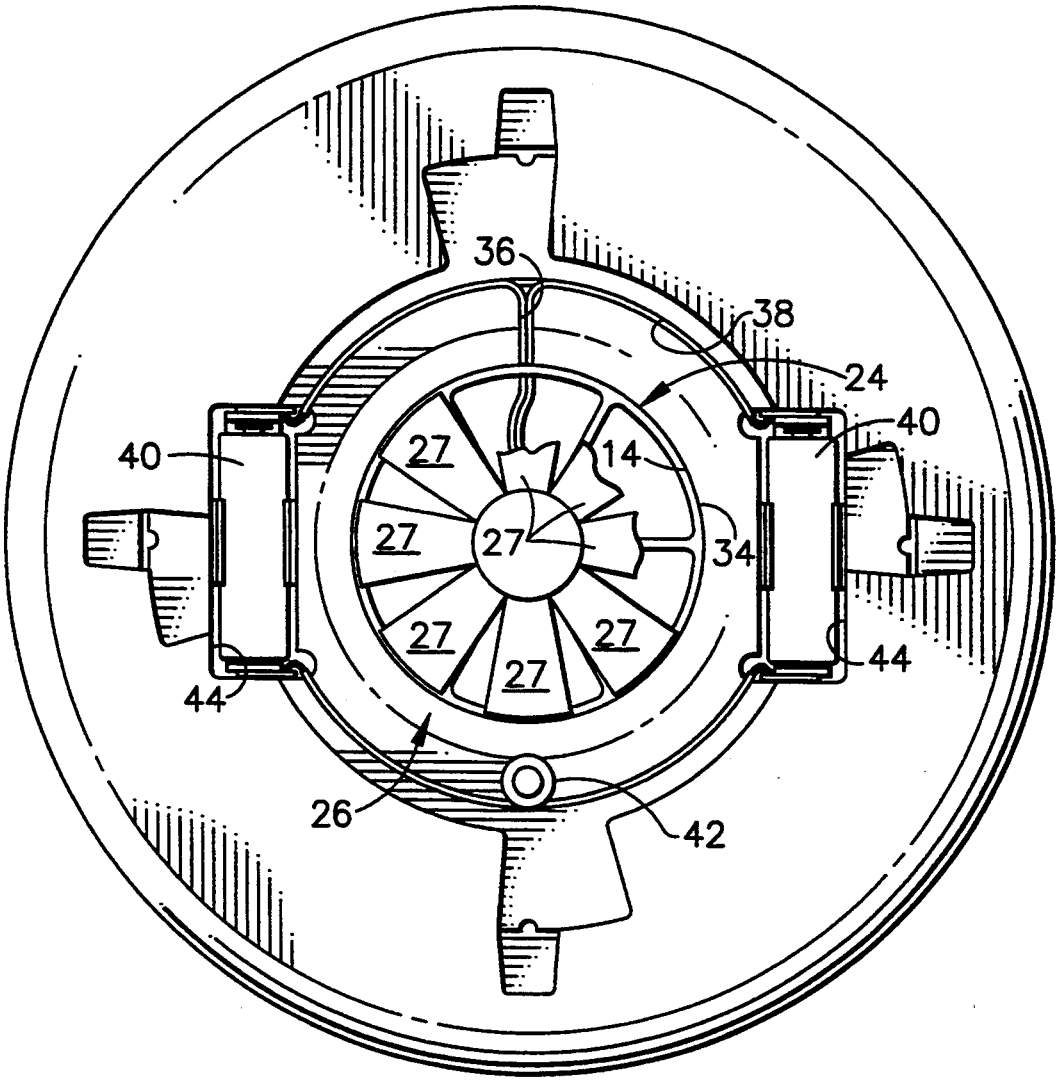
FIG. 5 is the same plan view as in FIG. 1 with its protective grill and retaining means removed to show the body and power means without obstruction.
Figure 6:
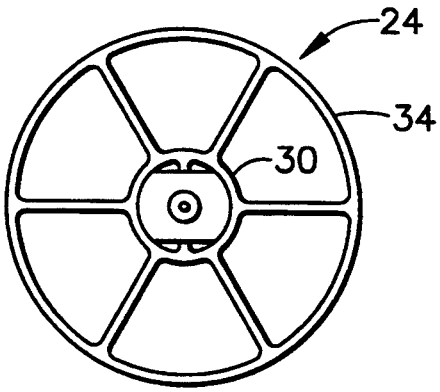
FIG. 6 is a plan view of the motor and mounting spider.
Figure 7:
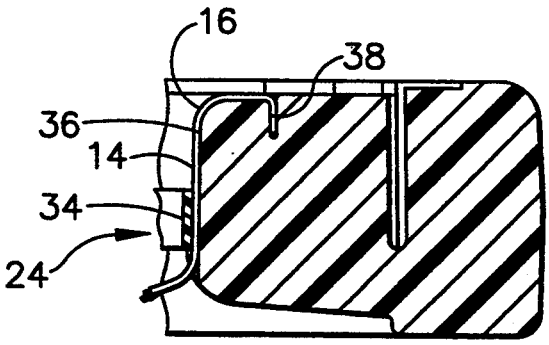
FIG. 7 is a fragmentary view in upright section taken along line 7—7 in FIG. 5.

In the following detailed description and the drawings, like reference characters indicate like parts. FIG. 1 shows a hovercraft toy 10 constructed in accordance with a preferred embodiment of this invention. As also shown in FIGS. 3 and 4, the hovercraft toy 10 is comprised of a body 12 preferably constructed of a low density expanded plastic such as polystyrene and incorporating a vertically disposed central air channel 14 therethrough that communicates from an upper bellmouth inlet 16 to a lower chamber 18. The outer perimeter 19 of the chamber 18 communicates with an annular air bearing surface 20 that is integral with the bottom surface of the body 12. A shoulder 22 is integrally formed into the central air channel 14 just prior to its entry into the lower chamber 18. A motor mount spider 24 is inserted downwardly into the slightly conical air channel 14 until it rests upon the shoulder 22, being held in place by a slight compressive force against the walls of the air channel 14. A fan 26 having blades 27 is frictionally fit upon the extended end portion of the shaft of a motor 28 that is in turn frictionally fit into the central band 30 of the motor mount spider 24. The motor 28 is located within the central band 30 by depending motor stop hook 31(FIG. 4). Motor wires 32 extend outwardly to pass under an outer band 34 (FIG. 7) of the motor mount spider 24 and into a shallow channel 36 to pass upwardly along the air channel 14 and outwardly around inlet 16 to communicate with an annular wire channel 38. The annular wire channel 38 routes the motor wires properly to a pair of batteries 40 and switch 42 (FIG. 5). Each battery 40 is mounted in a known battery holder and the combination is frictionally inserted into a battery cavity 44. Each cavity is opposedly mounted in the top of the body 12 for balance as is appropriately shown in the figures.

A bellmouth inlet 16 is used here since it is the most efficient way to accelerate static air to a uniform velocity profile within the air channel 14 for presentation to the fan 26. The conical air channel 14 is a result of draft angle necessitated by the molding process in order to be able to remove the body 12 from a mold. One can take advantage of this feature by sizing the outer diameter of the motor mount spider 24 so it fits easily into the top of air channel 14. As the motor mount spider 24 is pushed downwardly to ledge 22, it comes into increasing interference with the air channel 14, wedging itself adequately into the relatively soft polystyrene.

Axial Flow Fan

As can be seen most easily in FIG. 3, the axial flow fan 26 is multibladed with the blades 27 set at a low angle of attack. When looking at the fan in plan view as shown in FIG. 5, it is apparent that the blade disc is rather solid, that is, there is not much visible space between blades. This configuration is required to maximize the pressure producing capacity of the axial flow fan without allowing a pressure drop as the fan blades are driven into stall. The fan therefore functions as a pressure disc, whose resultant force is delivered through the motor 30 and the motor mount spider 24 to the body 12. This type of fan are ideal for use in air cushion vehicles where good pressure holding capacity and quick volume recovery is required. It is typical of aircraft cabin pressurization fans that have similar requirements.

Protective Grill

Figure 2:
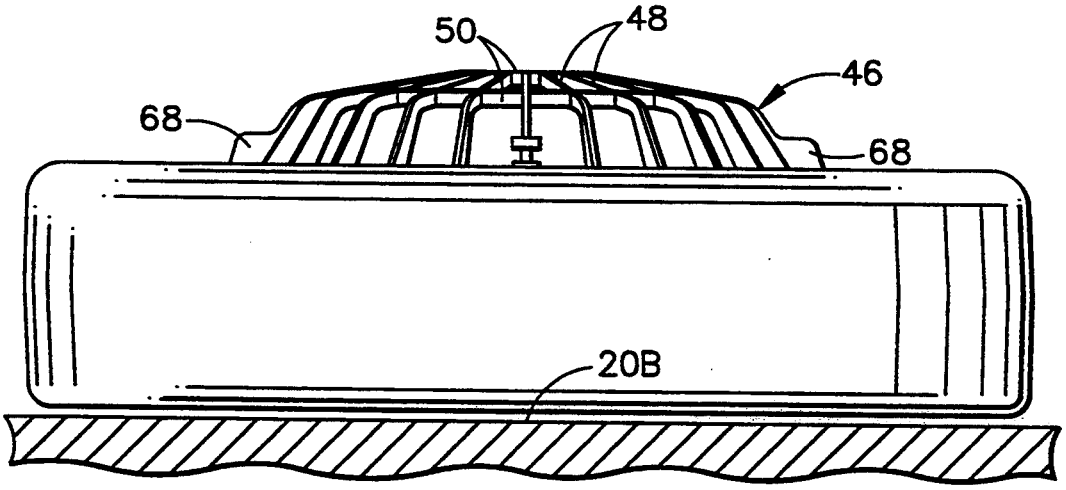
FIG. 2 is a side elevational view of the hovercraft toy of FIG. 1.

A protective grill 46 shown in FIGS. 1 and 2 contains radial and annular ribs 48 and 50 respectively, spaced to produce a matrix small enough to prevent someone, especially a small child from sticking fingers into the fan 26. The radial members 48 extend outwardly and downwardly to a horizontally disposed mounting ring 52. Four equally spaced locking tabs 54 extend outwardly from the horizontally disposed mounting ring 52. The grill 46 is fitted into a slight depression 56 (FIG. 3 and 4) in the top of the body 12 such that the locking tabs 54 reside adjacent cooperating retainers 58. With a small clockwise rotation then, the locking tabs 54 of the protective grill 46 are inserted under retainers 58. Each retainer 58 is formed in the shape of a "tee" incorporating a stem 60 as is best seen in FIG. 3. The stem 60 is a rectangular flat 62 whose vertical edges incorporate teeth 64. Each retainer 58 is somewhat compressively inserted into cooperating narrow cavities 66 cooperatively spaced in the top of the body 12 of the hovercraft toy 10. The radial members 48 of the protective grill 46 that are in radial alignment with the locking tabs 54 incorporate extensions 68 that provide a convenient surface upon which to exert torque while locking the protective grill to the top of the body 12. The extensions 68 also provide mechanical stiffening to the locking tabs 54. It is contemplated that these parts be made of appropriate plastics consistent with the design criteria of light weight, toughness and appearance and preferably are amenable to the injection molding process, following such techniques as are well known to those skilled in that art.

With respect to weight, an operational prototype of hovercraft 10 weighed slightly more than four (4) ounces including two nicad rechargeable batteries. The motors are understandably sub-fractional horsepower, with outputs in the range of approximately 1 to 6 watts. The application of full scale technologies to such a small scale model is not easy to achieve if performance and efficiency are design criteria, not just simply minimal functionality, i.e. marginally enough power to barely hover for a relatively short period of time between recharging or replacement of the batteries. Performance is understood to mean the maximization of hover height and run time, which has to do with the power to weight ratio of a particular vehicle configuration under consideration.

Radial Outflow Fan

Figure 8:
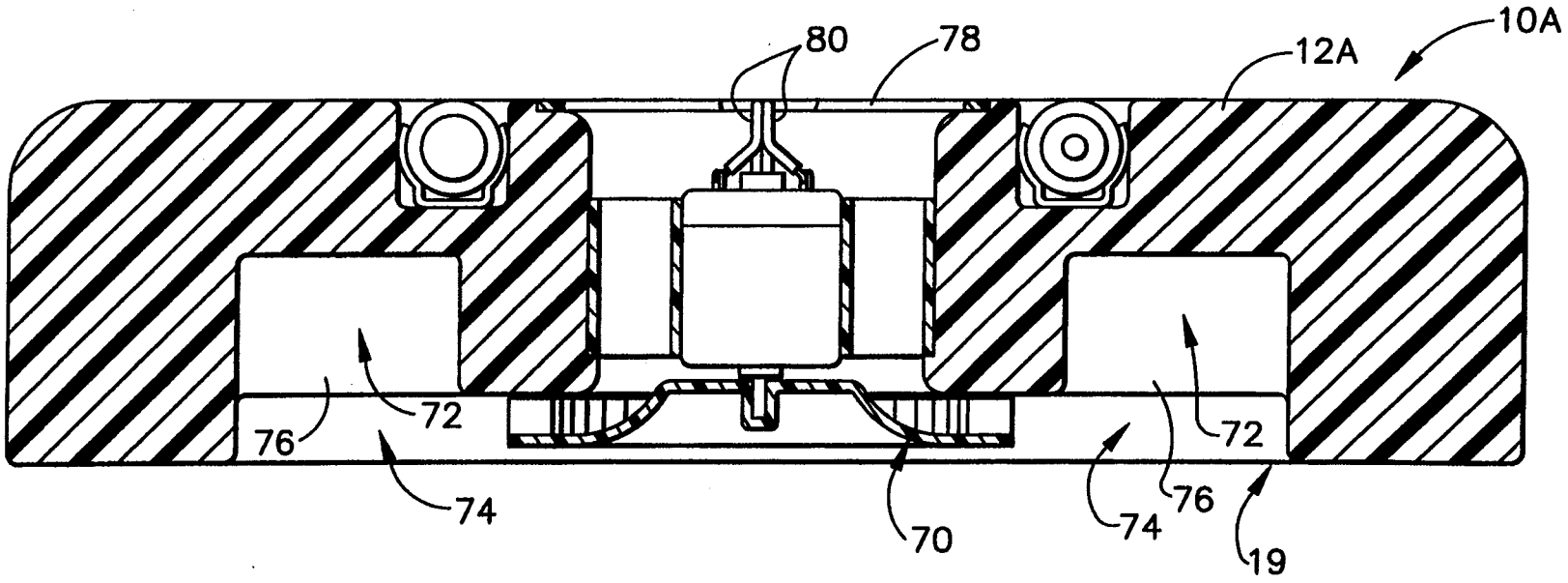
FIG. 8 is an alternate embodiment of the plenum chamber ground cushion machine of FIG. 4 utilizing a radial outflow or centrifugal flow fan.

FIG. 8 shows an alternate embodiment of the hovercraft toy 10A. It differs from the hovercraft toy 10 only in that it utilizes a radial outflow or centrifugal fan 70 mounted in a body 12A. Since this fan takes up less space, it affords even greater opportunity to use coring 72 to reduce body weight than would be appropriate with the body 12 of hovercraft toy 10. Coring is a molding term to denote that material is removed from an object in appropriate areas where structure and function are not affected. Radial stiffness can be maintained by a plurality of radial ribs 76 if desired. An annular hollow volume 74 is shown about the underside of the body 12A. A flat or slightly domed inlet screen 78 can be utilized to protect the motor wires 80 since the air passage to the fan 70 is too small for anyone's finger to reach the rotating part. Otherwise construction of this embodiment is largely the same as the hovercraft toy 10.

Anti-torque Means

The embodiment of hovercraft 10 and 10A, being single motor models, rotate upon the air bearing due to the torque of the fan 26. It has been demonstrated that static or fixed anti-torque means, such as exit stator vanes, are not satisfactory since the stator torque curve crosses the fan torque curve at only one point. The torque mismatch gets larger the farther away from this balance point the fan operates. Satisfactory anti-torque has been achieved in a twin motor configuration where each motor operates from a common power source as will be described more fully hereinafter.

Materials

Figure 9:
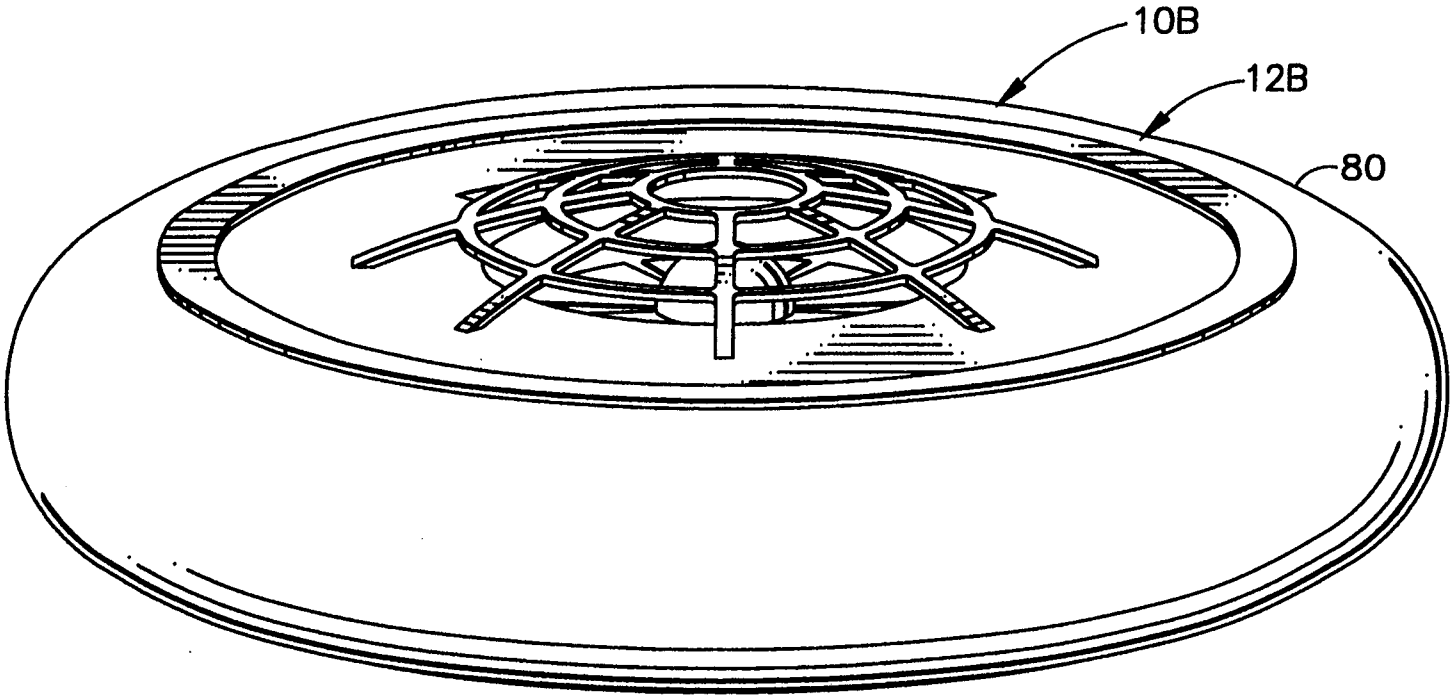
FIG. 9 is an alternate embodiment of a plenum chamber ground cushion machine of the previous figures depicting an injection molded central body surrounded by a shock absorbing toroidal ring.

In these preferred embodiments it is contemplated that the body and other parts be constructed as light as possible to enable the toy to hover as long as possible on two rechargeable "AA" size batteries for the purposes of economy and performance. Two approaches are appropriate. Polystyrene of from one (1) to three (3) pound per cubic foot density would be appropriate for the body portion of the preferred models described herein. Tests of a prototype exhibiting such construction has proven that this hovercraft toy can operate for up to 25 minutes on a single charge. Other low density materials such as formed plastics and elastomers could also be used if sufficient structural stability and integrity are present. Another contemplated type of construction is indicated in FIG. 9, wherein the body 12B of another embodiment of hovercraft toy 10B is injection molded of ABS or other suitable plastics and fulfill the design criteria of toughness and lightness. Such structures consist of thin shells which may be stiffened by webs or other features necessary for holding the batteries, wires, switch and motor and providing mounting points as required if more than one piece construction is required. A moroidal shock absorbing cushion 80 circumscribes the periphery of the body 12B allowing the hovercraft toy 12B to be used in a rather rough manner it is believed that the complete injection molding alternative will not yield the most favorable power to weight ratio, although it may be acceptable for use in my game.

Stability of Plenum Chamber

The embodiments of hovercraft toy 10, 10A, and 10B is essentially a plenum chamber ground effect machine. An inverted saucer embodiment of a plenum chamber ground cushion vehicle exhibits marginal dynamic stability. In short, even a moderate unbalanced force will cause the vehicle to drag on one side or the other without adequate means to right itself in an appropriate length of time. Referring to FIG. 4 again, stability is greatly enhanced in the hovercraft toy 10 by utilizing the annular air bearing 20 of width 20A. The width 20A is such as to provide a sufficient back pressure in lower chamber 18 consistent with the operating curve of fan 26. All air moving means (in this particular case a fan) exhibit a flow versus pressure characteristic otherwise referred to as an operating curve. At a given speed there is only one point on the operating curve that gives optimal efficiency. The pressure drop through the air bearing is therefore matched to the fan's efficiency point at its normal operating speed.

The dynamics of the air film between the air bearing surface 20 and the supporting surface 20B defines the pressure drop available along length 20A. As air flows into the air bearing at inner circumference 19, it enters around radius 19A and requires a length of 20C to establish itself in stable flow. The pressure drop through this region is non-linear and changes in good magnitude in response to changes in hover height. From thereon to the exit at atmosphere the flow is largely stable and the pressure drop is mostly linear. Changes in hover height and angle will cause this pressure distribution to become non-linear, although the magnitude of the pressure changes is more relevant. It is believed that the pressure changes in the inlet portion of the air bearing undergo larger slope changes than that through the stable section, therefore the inlet portion of the bearing is potentially more valuable in producing a restoring couple than the stable portion. Both portions of the air bearing are much more powerful in producing a restoring couple than that available from the dynamics of the cushion itself. The extreme of the entire bottom surface of the toy becoming an air bearing is impractical and was determined to reduce hover height and increase the power required. A simple orifice exit as is typical in simple plenum chamber cushions does not have the proper width to hover height ratio necessary to develop the air bearing flow characteristics and consequently the magnitude of pressure drop required to function as a means to produce a powerful restoring couple. More simply it does not have nearly enough annular area to provide a meaningful restoring force.

The lower chamber 18 functions as an air diffusion chamber and is configured or shaped to slow the air as much as possible. More particularly FIG. 4 illustrates an area expansion intended to efficiently diffuse the flow as much as possible. FIG. 8 illustrates a rapid area expansion upon exit from the centrifugal fan 70, combined with a further area expansion throughout annular hollow opening 74. If coring 72 is used it will simply dump the air into the enlarged volume with what remains of its associated pressure. If the air at the inner circumference 19 of the annular air bearing surface 20 is static, then the air exiting beneath the surface 20 will take a radial path minimizing the torque effects produced by a non-radial exit velocity.

Twin Motor/Fan

Figure 10:
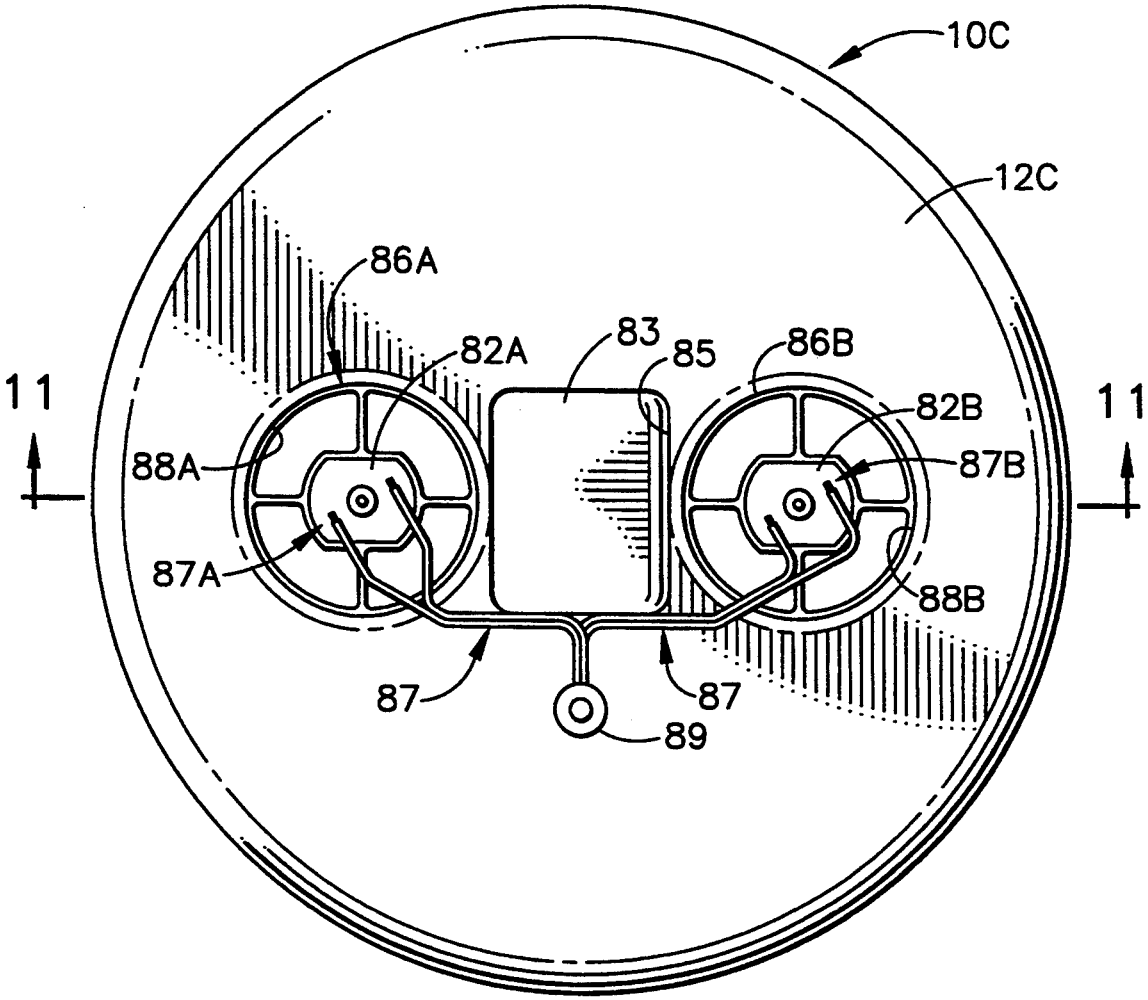
FIG. 10 is a plan view of an alternate embodiment of a peripheral jet ground cushion toy utilizing two motors as an anti-torque means.
Figure 11:
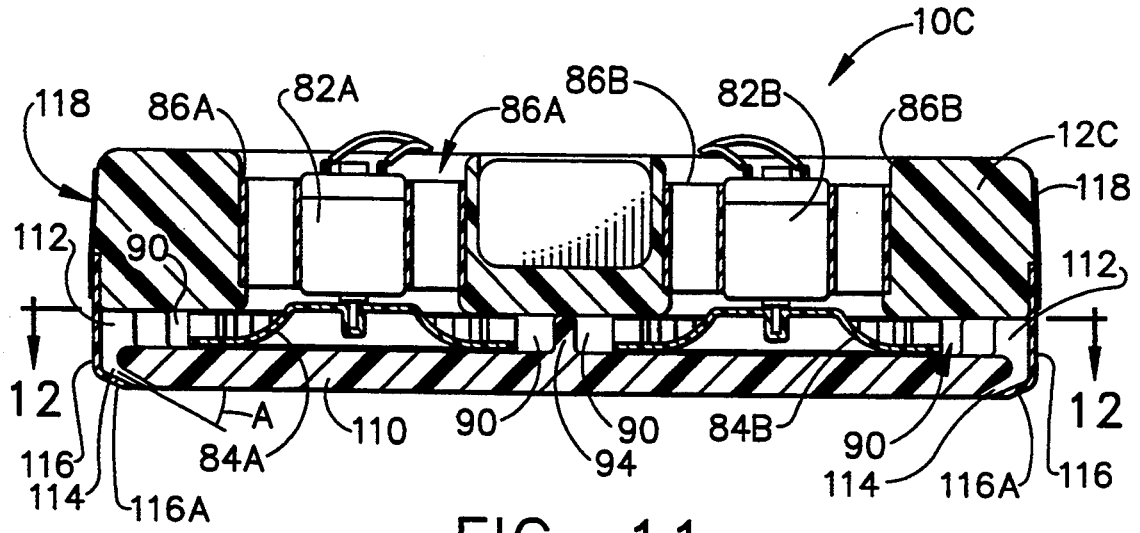
FIG. 11 is an upright sectional view taken along line 11—11 of FIG. 9.
Figure 12:
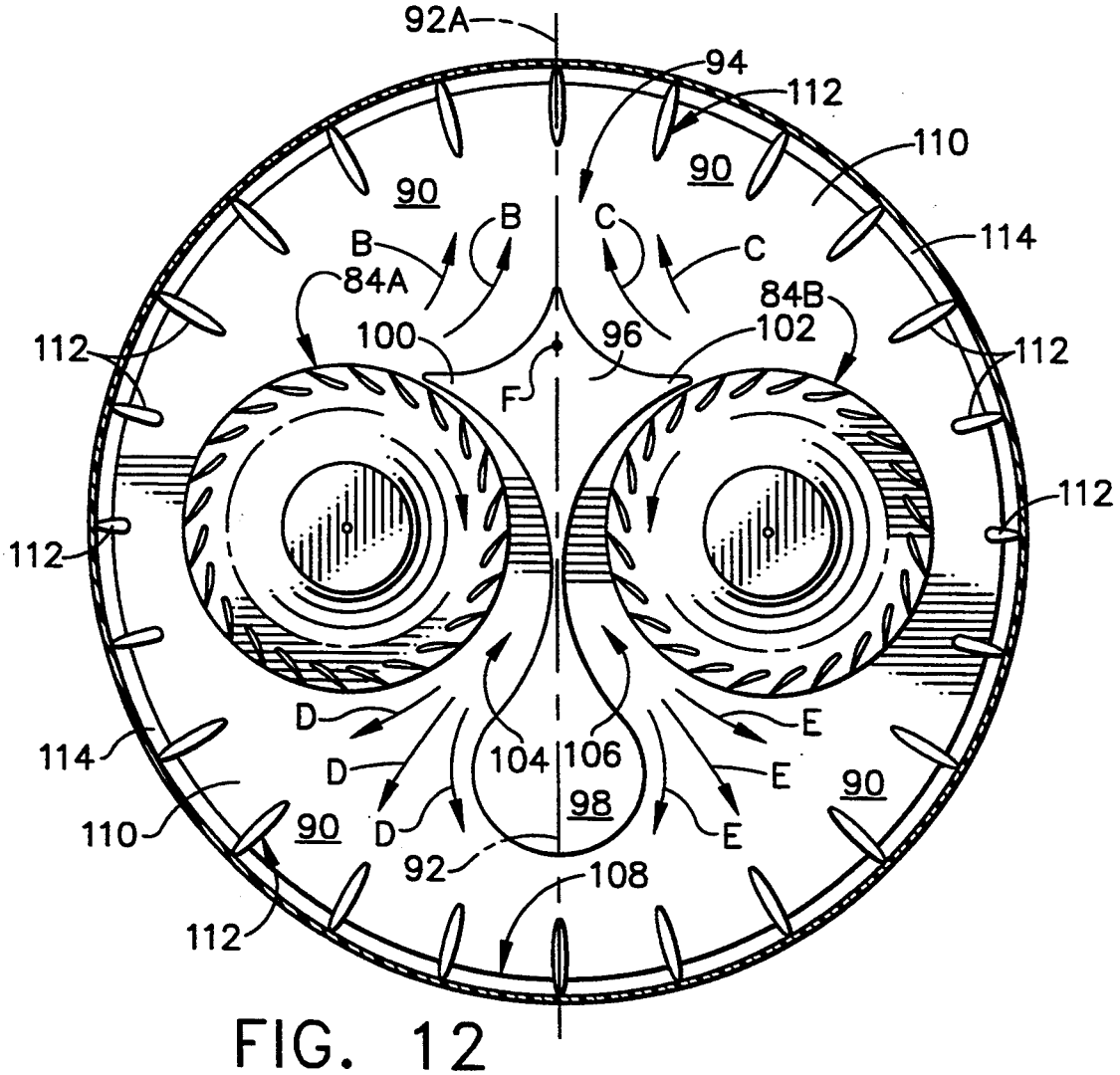
FIG. 12 is a sectional plan view taken along 12—12 of FIG. 11.

Another embodiment of this invention is shown in FIGS. 10, 11 and 12 wherein a hovercraft toy 10C is comprised of a body 12C incorporating counter rotating motors 82A and 82B. As before, radial outflow fans 84A and 84B are mounted to the extended end portions of the motor shafts of motors 82A and 82B that are in turn frictionally fit into motor spiders 86A and 86B. Spiders 86A and 86B are subsequently frictionally fit into vertical air passages 88A and 88B in the same manner as the motor 28 of hovercraft toy 10. Power is supplied to the counter rotating motors 82A and 82B from battery pack 83 removably lodged in battery cavity 85. In a similar manner as that of hovercraft 10, wires 87 communicate to counter rotating motors 82A and 82B through push-button switch 89. A prototype of this configuration used five (5) "AA" rechargeable batteries to achieve a run time of approximately 25 minutes. A protective screen (not shown) could be employed to protect wire connections 87A and 87B to motors 82A and 82B respectively. Similarly, counter rotating fans 84A and 84B draw air through passages 88A and 88B, and delivers that air into plenum 90 that is shown in plan view in FIG. 12. The purpose of plenum 90 is to diffuse the air efficiently, reducing air velocities as much as possible as was previously described with respect to hovercraft toy 10. Air does not uniformly disperse from counter rotating fans 84A and 84B but coalesces along a centerline 92 to deliver a disproportionate amount of air to one side of the vehicle, that is downwardly with respect to FIG. 12. This is a result of operating mirror image fans in close proximity to each other, thereby producing a virtual solid barrier 92A between them.

The flow approaching normal to the virtual solid barrier 92A will stagnate, as indicated at point "F" in FIG. 12. Air coalescing below point "F" will move downwardly of FIG. 12 while that coalescing above "F" will move upwardly. Such an abundance of air on one side of the craft would produce a substantially uneven jet, which would cause that side of the craft to lift higher and the opposing side to sink proportionately.

Statorless Air System

A conventional approach to avoiding this imbalance would be the use of exit stator vanes. Such vanes would have to be closely coupled to its fan and spread the flow unsymmetrically therefrom, such that the sum of air flow emerging from the two fans reached the outer periphery of plenum 90 in a uniform distribution. Such highly detailed blades, being in a high velocity region would yield unacceptable pressure losses. This imbalance is avoided by utilizing a flow barrier 94. Flow barrier 94 is comprised of a top portion 96 and a bulbous bottom portion 98. With respect to FIG. 12 the top portion 96 further incorporates a left side splitter 100 and a right side splitter 102. The splitters 100 and 102 separate air coming from fans 84A and 84B respectively at appropriate radial locations to bring an appropriate amount of air into partial volutes 104 and 106 respectively. The air that does not enter under left and right side splitters 100 and 102 respectively travels along the tops thereof to be guided upwardly with respect to FIG. 12 along the centerline 92 as is indicated at arrows B an C. Now referring to the bottom portion of FIG. 12, the end of the volutes 104 and 106 terminate in the bulbous end 98, requiring the air from the volutes 104 and 106 to diffuse and spread more evenly toward an annular opening 108 as is indicated by the flow arrows D and E. It does not matter at this point whether the plenum chamber or peripheral jet type of air cushion is utilized in this configuration. Since the previous configurations have described the plenum chamber type, this configuration will be described in conjunction with a peripheral jet design.

Peripheral Jet

Flow barrier 94 is an integral part of a bottom 110 as is shown in FIGS. 11 and 12. Bottom 110 incorporates a plurality of exit guide vanes 112 that give radial guidance to the air exiting the plenum 90. With respect to FIG. 12 note that the exit guide vanes at the 90 degree and 270 degree points in the 1st and 3rd quadrants and those adjacent thereto to a lesser degree are shorter than the others to allow more time and distance for air exiting fans 84A and 84B adjacent thereto to diffuse, thus providing more even air flow to enter the exit guide vanes 112 in those quadrants. As the air turns radially outward it turns downwardly around the periphery of the bottom 110 to enter an annular jet nozzle 114. The inner boundary of the annular jet nozzle 114 is formed by the chamfered and rounded perimeter of bottom 110, while the outer boundary is formed by an annular connector ring 116. The meanline or angle "A" of the annular jet nozzle 114 is determined by the momentum theory of peripheral jet hovercraft, and is well known to those skilled in the art. The lower lip 116A of the annular ring 116 also functions as a mechanical retainer for the bottom 110. The upstanding portion of the annular connecting ring 116 is slipped over the outer diameter of the body 12C and is attached thereto by a decorative adhesive band 118 that circumscribes the body 12C. The top extremities of the plurality of exit guide vanes 112 and the flow barrier 94 should be adhesively or fixedly attached to the underside of the body 12C to prevent air pressure inside the plenum 90 from blowing the bottom 110 downwardly. Under such circumstances internal pressure would deform the bottom 110, bulging it at the center, resulting in a significant reduction in effective hover height.

Stability

Stability of the hover craft 10 is derived from the dynamics of the air exiting lower chamber 18 through air bearing 20 (FIG. 4). In like manner stability of hovercraft embodiment 10A and 10B is achieved by the air exiting annular hollow volume 74 through its air bearing (FIG. 8 and 9). Similarly, stability of hovercraft embodiment 10C is achieved from the dynamics of the air exiting plenum 90 (FIG. 11) through annular jet nozzle 114. As the embodiments 10, 10A, and 10B are tilted from horizontal, elevated pressure profiles are generated at the air bearing 20 inlet as well as through the remainder of the width 20A thereof which act upon the crescent periphery of the depressed side. Conversely, a lowered pressure is generated about the crescent periphery of the opposing elevated side. This produces a dynamic restoring couple which will right the hovercraft provided the craft's center of gravity is within reasonable distance of its geometric center.

In an analogous manner, and depending upon similar limitations of unbalance, air exiting the peripheral jet of hovercraft embodiment 10C produces an elevated pressure crescent about the periphery of the depressed side of the craft and a reduced pressure crescent about the elevated side of the craft, thereby producing a similar restoring couple even though the air flow mechanism is different. If part of the peripheral nozzle is closed, air will simply redistribute itself to the open portion of the nozzle. When dealing with a circular planform rigid craft over a rigid and functionally flat surface, it is impossible to close any significant portion of the peripheral nozzle, therefore the majority of the nozzle about the depressed side continues to operate with sufficient mass flow to generate a substantial restoring moment.

Battery Power

For safety, economy, performance and convenience, the hovercraft toy 10, 10A, 10B, 10C is battery powered. Rechargeable batteries and quick charge battery chargers can afford the operator unlimited running time by simply alternating batteries. It is also apparent that the toy can be operated on chemical batteries. Chemical batteries will run longer but are not reusable. Also more batteries could be used subject to performance considerations.

Use

To prepare the hovercraft toy 10 for use ( see FIGS. 1 through 5), one need only to insert two "AA" size batteries with the correct polarity in the battery holders and push them into the battery cavities 44. Push the switch 42 to the off position if necessary. Place the protective grill 46 on top of the body 12, aligning it with depression 56 such that locking tabs 54 are adjacent the retainers 58. A small clockwise rotation using the extensions 68 of the protective grill 46 will secure the protective grill in place. One radial member 48A has been truncated to permit unobstructed access to the switch 42. The protective grill 46 is secured and the hovercraft toy 10 is ready for use. In operation the hovercraft toy 10 will begin to rotate opposite the rotation of the propeller since it does not possess an anti-torque device. The hovercraft toy 10C of FIGS. 10 to 12 does not exhibit rotation due to the counter rotating motor and fan concept.

Game

Figure 13:
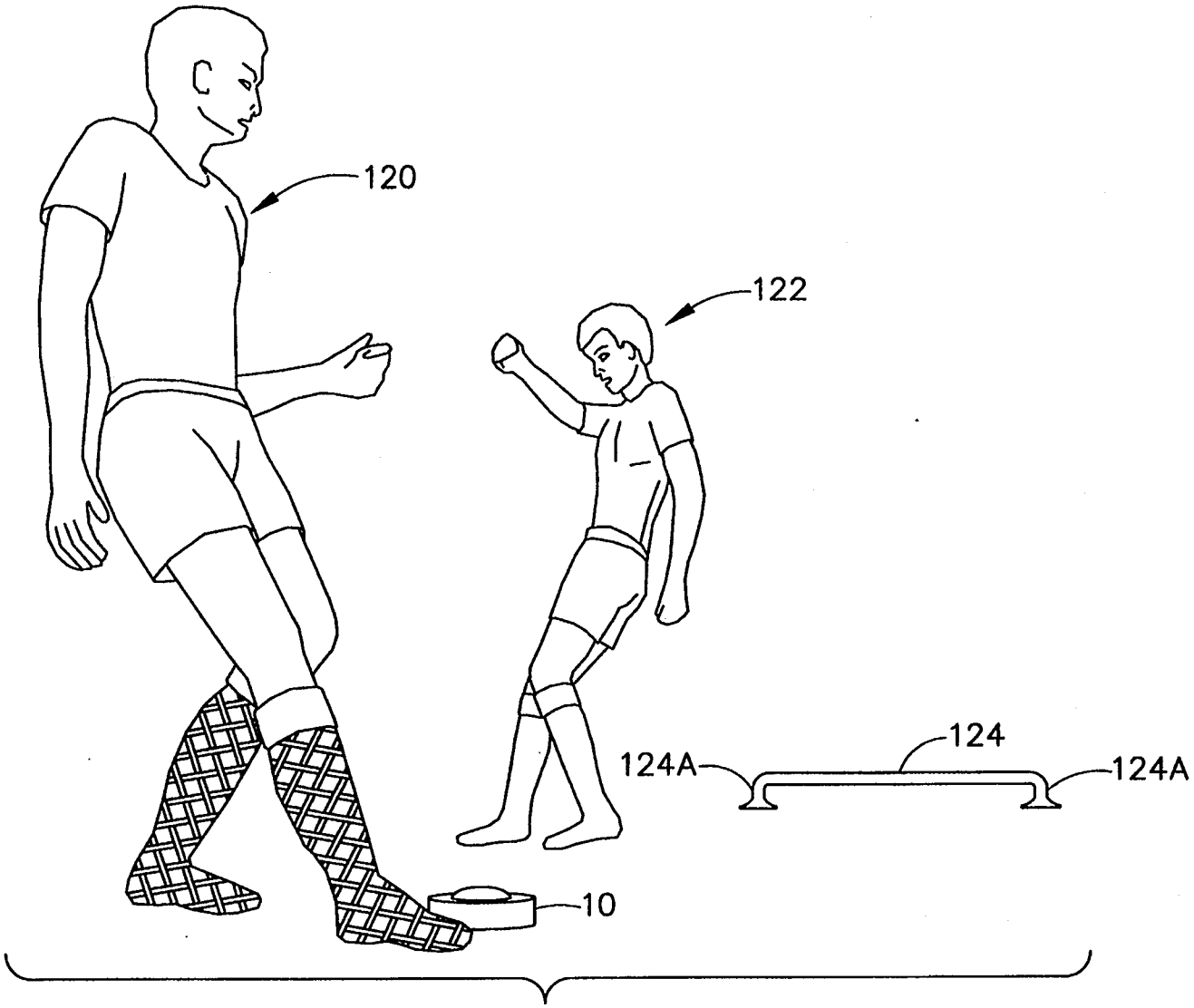
FIG. 13 is an environmental view of the hovercraft toy being used in the game according to this invention.

According to my game which I have invented, as illustrated in FIGS. 1 and 13, one use of the hovercraft toy 10 is to simulate a "Puck" in a game where players such as 120 and opposing players 122 form teams and motivate the hovercraft toy 10 above a relatively smooth playing surface with an appropriate instrument such as a hockey or hockey-type stick or a broom, or even with their feet, preferably stocking to protect the toy, until the toy can be guided across a goal line defined between two goals. The goal posts may support a goal bar 124, and may be attached to the floor by suction cups 124A or weighted such that it will move if a player runs into it. Any floating toy as described herein, including the plenum or peripheral jet configurations, can be employed here. Surface roughness would be the primary consideration. If the torque rotation of the hovercraft toy 10 is considered an asset to the game in that it adds another degree of uncertainty, then the single motor versions would be employed. If the rotation of the toy is considered undesirable, then the twin motor models described above would be more appropriate. For durability, the hovercraft toy 10 could utilize the alternate construction of injection molding for the body 12 and other parts. Use of the toroidal cushion 80 would be advantageous for any construction in protecting the toy as well as the players and environment.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiments were chosen and described in order to best illustrate the principles of the invention in various arrangements and with various modifications as are suited to the particular use contemplated. It is intended that the scope of the invention be defined by the claims appended hereto.

We claim:

1. A method of playing a game, comprising the steps of:

(a) providing a playing surface adequate to accommodate mobile playing personnel;

(b) providing a craft which hovers substantially continuously above said playing surface when said craft is stationary above said playing surface and when said craft is moving across said playing surface;

(c) providing means carried by said craft for continuously discharging gas over an extended period of time during which said game is being actively played, said gas being discharged downwardly to support the hovering of said craft such that the movement of said craft across said playing surface is substantially frictionless;

(d) providing at least one goal on said playing surface; and (e) providing at least one team having at least one player, each of said at least one goal being associated with a respective team as a target objective, each of said at least one team having as an object to move said craft across its respective target goal, movement of the craft being accomplished by pushing or kicking said craft.

2. The method of claim 1 wherein said at least one team comprises first and second competing teams and said at least one goal comprises first and second goals, said first goal being associated during play with said first team only, as its target objective, said second goal being associated during play with said second team only, as its target objective, and wherein each team has as an object to move said craft across its respective target goal.

3. The method of claim 2 wherein each team has as an additional object to defend or prevent the movement of said craft across the target goal associated with the other or adversary team.

4. The method of claim 1 wherein each of said at least one goal is defined by a pair of spaced apart goal posts.

5. The method of claim 1 wherein each of said at least one goal includes a horizontal cross bar spaced above said playing surface and defining said goal between said horizontal cross bar and said playing surface.

6. The method of claim 1 wherein said craft includes a resilient cushion disposed about at least a portion of said craft.

7. The method of claim 1 wherein said at least one player has a hockey type stick and wherein the movement of said craft is accomplished by said at least one player pushing or hitting said craft with said hockey type stick.

8. The method of claim 1 wherein each of said at least one goal is associated with only one respective team.

9. The method of claim 1 wherein said craft comprises:

(a) a body defining, in cooperation with said playing surface, a fluid plenum, said fluid plenum having an inlet and an outlet, said body having a rigid peripheral surface disposed adjacent and surrounding said outlet;

(b) means for continuously flowing fluid through said fluid plenum, said means including a fan; and (c) said rigid peripheral surface being configured to cooperate with the underlying playing surface to form a fluid bearing when fluid flows therebetween, said fluid bearing having a width which is sufficient to (i) provide a first lifting force to said body; and (ii) backpressure said fluid plenum such that the fluid pressure within said fluid plenum provides a second lifting force to said body, the sum of said first and second lifting forces being sufficient to maintain said craft in a substantially spaced apart relationship above the underlying playing surface.

* * * * *

US005429359B1

REEXAMINATION CERTIFICATE (3212th)

United States Patent [19]

[11] B1 5,429,359

Timperman et al.

[45] Certificate Issued Jun. 3, 1997

[54] HOVERING CRAFT AND GAME

[76] Inventors: Eugene L. Timperman, 10639 Silverbrook Dr., Cincinnati, Ohio 45240; Le T. Phan, 3235 Ferncroft, Cincinnati, Ohio 45211

Reexamination Request:
No. 90/004,234, Apr. 30, 1996

Reexamination Certificate for:

| | |
|---|---|
| Patent No.: | **5,429,359** |
| Issued: | **Jul. 4, 1995** |
| Appl. No.: | **243,553** |
| Filed: | **May 16, 1994** |

Related U.S. Application Data

[63] Continuation of Ser. No. 248, Jan. 4, 1993, abandoned.

[51] Int. Cl.[6] ..... A63B 67/14; A63F 7/07

[52] U.S. Cl. ..... 273/126 A; 473/588

[58] Field of Search ..... 273/126 R, 126 A, 273/128 R, 128 A, 128 CS; 446/178, 179

[56] References Cited

U.S. PATENT DOCUMENTS

| | | |
|---|---|---|
| D. 287,234 | 12/1986 | Chia . |
| 2,159,966 | 5/1939 | Dunham . |
| 3,078,938 | 2/1963 | Bollum, Sr. . |
| 3,078,939 | 2/1963 | Bollum, Sr. . |
| 3,090,327 | 5/1963 | Crowley . |
| 3,090,455 | 5/1963 | Crowley . |
| 3,153,461 | 10/1964 | Bollum, Sr. . |
| 3,177,959 | 4/1965 | Gaska . |
| 3,195,665 | 7/1965 | Beardsley . |
| 3,229,410 | 1/1966 | Bross . |
| 3,263,764 | 8/1966 | Bertin . |
| 3,331,462 | 7/1967 | Wernicke . |
| 3,365,017 | 1/1968 | Hardy et al. . |
| 3,488,882 | 1/1970 | Scott . |
| 3,536,155 | 10/1970 | Bertin . |
| 3,548,969 | 12/1970 | Paull et al. . |
| 3,656,575 | 4/1972 | Vryland . |
| 3,687,217 | 8/1972 | Mueller . |
| 3,691,670 | 9/1972 | Lemelson . |
| 3,747,726 | 7/1973 | Walter . |
| 3,870,309 | 3/1975 | Tessier . |
| 3,954,267 | 5/1976 | Freeman et al. . |
| 4,068,735 | 1/1978 | Grihangne . |
| 4,076,242 | 2/1978 | Joseph . |
| 4,175,637 | 11/1979 | Bertlesen . |
| 4,249,334 | 2/1981 | Goldfarb et al. . |
| 4,416,346 | 11/1983 | Logan . |
| 4,427,086 | 1/1984 | de Coiselet . |
| 4,507,096 | 3/1985 | Greenfield, Jr. . |
| 4,516,651 | 5/1985 | Duchateau . |
| 4,666,012 | 5/1987 | Howell et al. . |
| 4,964,835 | 10/1990 | Suto . |
| 5,014,990 | 5/1991 | Kaser et al. . |
| 5,045,013 | 9/1991 | Fujitani . |

OTHER PUBLICATIONS

Air Pro™ Hockey Product Package, ©1991 Mattel, Inc.
Air Pro™ Hockey Instruction Manual, ©1991 Mattel, Inc.

*Primary Examiner*—Raleigh Chiu

[57] ABSTRACT

An axial or centrifugal fan is motor mounted and the motor in turn is mounted within the central portion of a preferably low density or light weight annular or orientation free structure. Fan driven air is delivered downwardly through the central portion of the structure and is efficiently diffused underneath thereof. The air exits to atmosphere through an air bearing or a peripheral nozzle, both of which provide a strong stabilizing moment to the craft. The annular structure simulates a hockey puck to be used in a game similar to ice or field hockey. The Puck can be motivated from player to player and subsequently toward a goal by the players feet or by other desirable instruments. The preferred goal is comprised of a horizontal bar to encourage players to keep the toy on the playing surface. The puck is provided with a resilient outer periphery to prevent damage to itself and the playing environment. If a non-rotating puck or toy is contemplated, a dynamic antitorque model incorporates two counter-rotating motors and fans in a statorless arrangement.

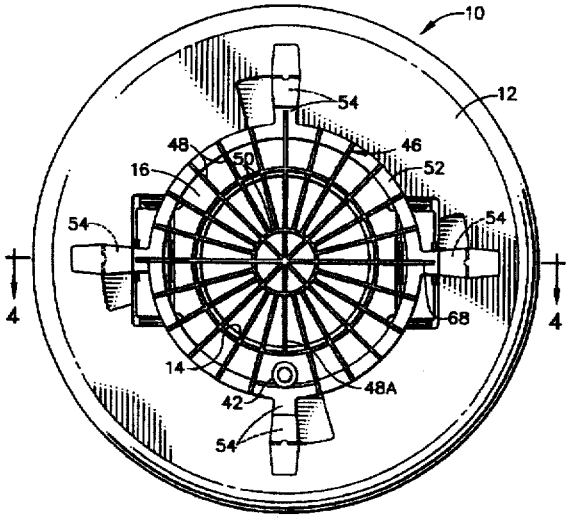

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–9 are cancelled.

* * * * *